US006748926B2

(12) United States Patent
Lee et al.

(10) Patent No.: US 6,748,926 B2
(45) Date of Patent: Jun. 15, 2004

(54) MODULAR FUEL INJECTION PACK

(75) Inventors: Ki-Ho Lee, Windsor (CA); James K. Vanderveen, Blenheim (CA); James R. Morris, Newport News, VA (US)

(73) Assignee: Siemens VDO Automotive Inc., Chatham, CA (US)

( * ) Notice: Subject to any disclaimer, the term of this patent is extended or adjusted under 35 U.S.C. 154(b) by 0 days.

(21) Appl. No.: 10/345,546

(22) Filed: Jan. 16, 2003

(65) Prior Publication Data

US 2004/0000290 A1 Jan. 1, 2004

Related U.S. Application Data

(60) Provisional application No. 60/392,147, filed on Jun. 28, 2002.

(51) Int. Cl.[7] ..... F02M 55/02

(52) U.S. Cl. ..... 123/470; 123/184.21; 123/456; 439/130

(58) Field of Search ..... 123/470, 456, 123/469, 468, 184.21, 184.25, 184.43, 184.61; 439/130, 652

(56) References Cited

U.S. PATENT DOCUMENTS

| | | | | | |
|---|---|---|---|---|---|
| 4,857,003 | A | * | 8/1989 | Hafner et al. | 439/130 |
| 4,950,171 | A | * | 8/1990 | Muzslay | 439/76.1 |
| 5,030,116 | A | * | 7/1991 | Sakai et al. | 439/130 |
| 5,189,782 | A | * | 3/1993 | Hickey | 123/456 |
| 5,211,149 | A | * | 5/1993 | DeGrace, Jr. | 123/470 |
| 5,323,749 | A | * | 6/1994 | Gras et al. | 123/470 |
| 5,607,315 | A | * | 3/1997 | Bonnah, II et al. | 439/130 |
| 5,718,206 | A | * | 2/1998 | Sawada et al. | 123/470 |
| 6,422,191 | B1 | | 7/2002 | Braun et al. | |

* cited by examiner

*Primary Examiner*—Carl S. Miller

(57) ABSTRACT

Steel fuel rails are provided with the mechanical components of a plurality of fuel injector valve bodies. The electronics for operating those valves are molded into an injector pack. The valve bodies are inserted into the passages associated with the injector pack such that the electronics are part of a single molded plastic portion. A corrugated seal is sealed to an outer portion of the passage on the injector pack. Thus, the present invention eliminates the number of connections for supplying fuel that needed to be sealed in the prior art. Further, the number of required assembly steps is reduced over the prior art.

5 Claims, 2 Drawing Sheets

MODULAR FUEL INJECTION PACK

CROSS-REFERENCE TO RELATED APPLICATIONS

The application claims priority to U.S. Provisional Application No. 60/392,147, which was filed on Jun. 28, 2002.

BACKGROUND OF THE INVENTION

This invention relates to a fuel injector pack which is connected to a manifold at one end, and which receives a steel fuel rail having valve bodies. The injector pack is a molded plastic item that includes the electronics for the injector valve.

Fuel injectors are typically electronically controlled valves that are positioned between a fuel rail and an injector pack. Typically, the fuel rail is made of a metal and typically steel. Especially recently, the injector packs may be formed of a plastic. The interface between the passage in the injector pack which receives the valve, and which communicates the fuel into an airflow passage must be tightly sealed. Emissions from the fuel cannot leak through any of the connections due to strict governmental regulations. The prior art had several o-ring seals which in some cases may have allowed some vapor emissions.

In the prior art, providing the electrical connection to the injector valve was somewhat complex. Moreover, it was sometimes difficult to service the electrical connections. The valves and their associated electronics were somehow connected either to the fuel rail or to the injector packs, and the connection between the three components was then made.

This resulted in several connection interfaces, all of which need to be tightly sealed, and several assembly operations.

SUMMARY OF THE INVENTION

In a disclosed embodiment of this invention, the electronics for the valves are associated with the injector pack, while the valve bodies are associated with the fuel rail. The valves are inserted into openings in passages in the injector pack for communicating the fuel into an airflow passage. The electronics, including the coil for the valve are molded into the injector pack. A single seal is then placed between the injector pack and the valve. This is the only required seal, and the connections are thus easily made fluid tight.

In preferred embodiments of this invention, a manifold is also directly sealed to the top of the injector pack. The injector pack preferably includes wiring leading to each of the individual coils for each of the individual valves.

These and other features of the present invention would be best understood from the following specification and drawings, the following of which is a brief description.

DETAILED DESCRIPTION OF A PREFERRED EMBODIMENT

Figure 1:
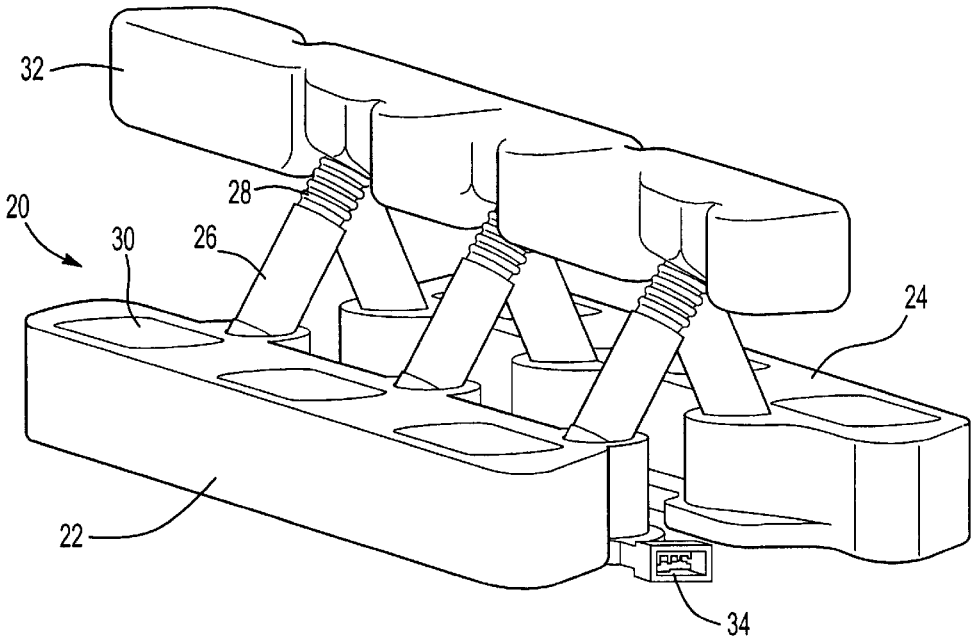
FIG. 1 is a top perspective view of a fuel rail and injector pack.

A fuel rail and injector pack assembly 20 is illustrated in FIG. 1. Injector pack halves 22 and 24 each include passages 26 which receive convoluted seals 28 to seal a fuel interface between a fuel rail 32 and the passages 26. Airflow passages 30 will receive an air manifold, and communicate air into a vehicle engine as will be better understood below. Electrical connections 34 connect to a wire harness. The connections 34 are part of the injector pack 22 and 24, which are preferably molded from plastic. The electronics for controlling a plurality of fuel injector valves within the passages 26 are provided with control signals through the wire harness which is connected to the connection 34.

Figure 2:
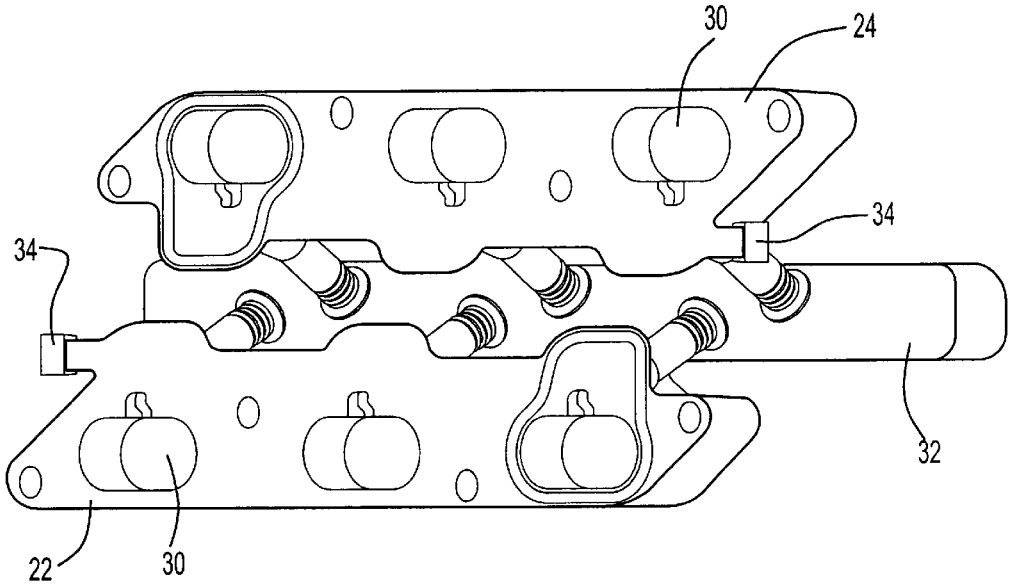
FIG. 2 is a bottom view of the FIG. 1 assembly.

FIG. 2 is a bottom view showing the air openings 30 and the injector packs 22 and 24. As can be seen, there are separate electrical connections 34 for each of the packs 22 and 24.

Figure 3:
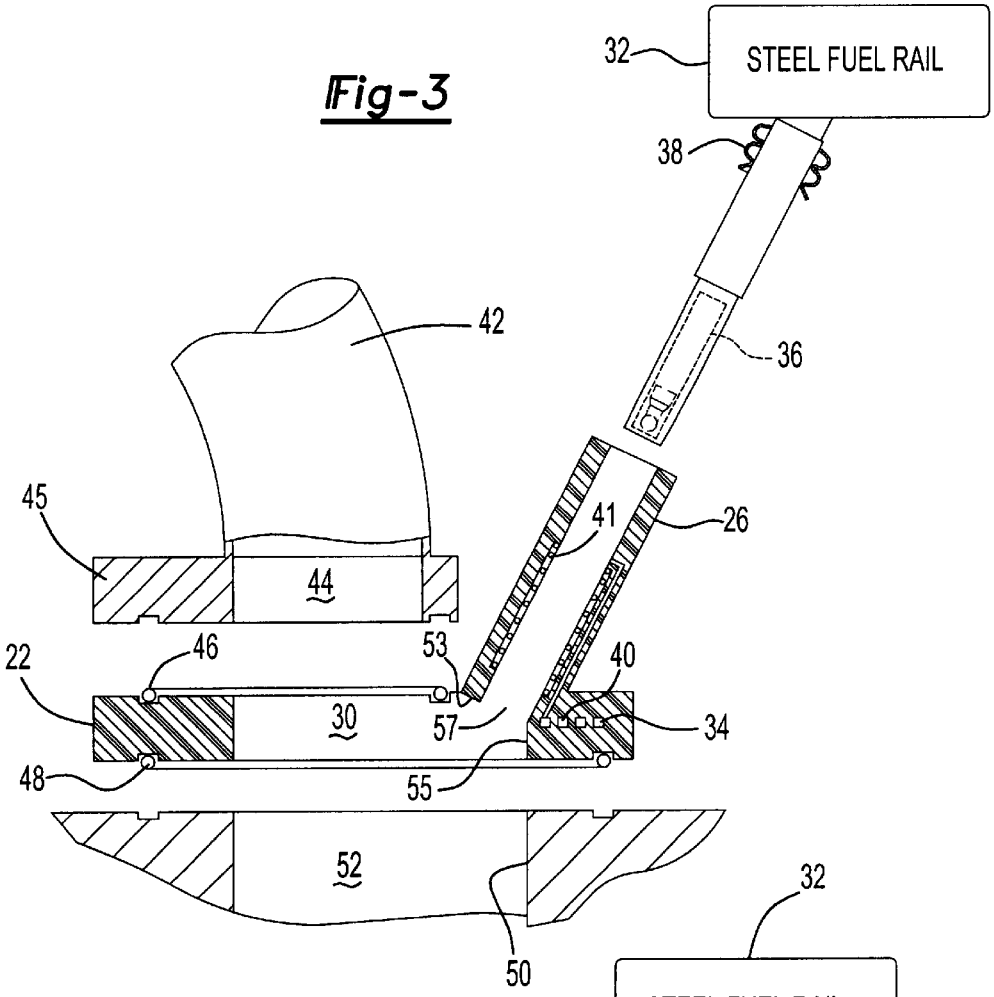
FIG. 3 is an exploded view of the three components that come together to form the inventive assembly.

FIG. 3 is an exploded view of the fuel rail 32, and its interior valve packages 36 (shown schematically). A corrugated seal 38 is shown attached to the valve body 36. As is known, the valve body 36 typically includes a moving solenoid valve that selectively allows or blocks flow of fuel from the fuel rail 32 through a passage to which it is delivered to an engine chamber. The passage 26 and the injector pack 22 receives the valve body 36. An electronic pack 40 including a coil 41 for powering the valve is part of the injector pack 26. The coil is preferably embedded into the plastic when the injector pack 22 is molded. Further, the connections 34 extend through to the several coils to selectively provide power to the coils in a predetermined cycle. In the illustrated embodiment, there are four wires with a central wire for powering each of the three illustrated coils, and a return wire.

As shown, the injector pack includes seals 46 and 48. The seal 48 seals on the top of an engine block 50. A passage 52 in the engine block communicates with the air passage 30. An air manifold 42 has an opening 44 and a manifold body 45. This body is received on the seal 46. In this manner, air is delivered to the air manifold 42, through openings 44, 30 and into opening 52. At the same time, fuel is delivered through the valve 36 to mix with the air and be delivered into the engine block at 50. The coils are selectively powered, as known, to drive valves 3*b*, and selectively open and close the fuel flow passages. As shown, the passage 26 includes an end wall 53 and another end wall 55. In combination, these end walls provide an opening 57 to allow the passage of fuel into the passage 52.

Figure 4:
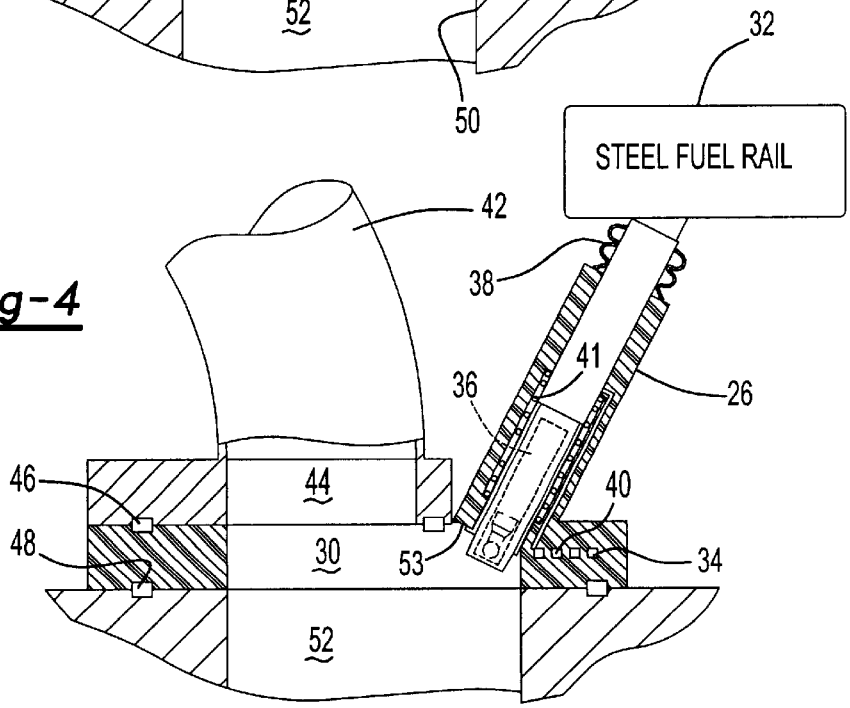
FIG. 4 is an assembled cross-sectional view.

FIG. 4 shows the components assembled together. As can be understood, the corrugated seal 38 is welded, or otherwise sealed at 54 to the passage 26. In this manner, the injector packs 22 or 24 can be easily replaced to replace the electronics should they fail. Further, there are many fewer seals and assembly steps than was the case in the prior art. The sole fluid connections which could be subject to leakage are sealed by seals 46 and 48, and the corrugated seal 38.

Thus, the present invention provides a simplified and more reliable connection between a fuel rail, an injector pack, an air manifold, and an engine.

Preferred embodiments of this invention have been disclosed, however, a worker of ordinary skill in the art would recognize that certain modifications would come within the scope of this invention. For that reason, the following claims should be studied to determine the true scope and content of this invention.

What is claimed is:

1. An air and fuel supply system for a vehicle engine comprising:

a fuel rail including a plurality of valve bodies;

an air manifold for delivering a plurality of separate air flows; and an injector pack having a plurality of passages for receiving air from said plurality of passages in said air manifold, and said injector pack having plastic molded passages to receive each of said valve bodies, said plastic molded passages including electrical controls for said valve bodies.

2. An air supply system as set forth in claim 1, wherein a corrugated seal is welded to an outer surface of said passage to seal a connection between said passage and said fuel rail.

3. An air supply system as set forth in claim 1, wherein a seal is positioned on said injector pack to seal the connection of said manifold to said injector pack.

4. An air supply system as set forth in claim 1, wherein said injector pack including a plug at one end to receive a connection to a wire harness, to communicate with said electrical controls.

5. An air supply system as set forth in claim 1, wherein said electrical controls include a plurality of control wires, with at least one of said wires associated with each of said valve bodies to provide a control signal to each of said valve bodies.

* * * * *